US005807088A

United States Patent [19]

Fukanuma et al.

[11] Patent Number: 5,807,088

[45] Date of Patent: Sep. 15, 1998

[54] SCROLL TYPE COMPRESSOR WITH CHAMFERED SCROLL WALL

[75] Inventors: Tetsuhiko Fukanuma; Yasushi Watanabe; Shinya Yamamoto; Kunifumi Goto, all of Kariya; Shigeki Iwanami, Okazaki; Yasushi Suzuki, Chiryu, all of Japan

[73] Assignees: Kabushiki Kaisha Toyoda Jidoshokki Seisakusho; Nippondenso Co., Ltd., both of Kariya, Japan

[21] Appl. No.: 650,421

[22] Filed: May 20, 1996

[30] Foreign Application Priority Data

May 23, 1995 [JP] Japan ..... 7-123835

[51] Int. Cl.[6] ..... F04C 18/04

[52] U.S. Cl. ..... 418/55.2; 418/55.4

[58] Field of Search ..... 418/55.2, 55.4

[56] References Cited

U.S. PATENT DOCUMENTS

| | | | |
|---|---|---|---|
| 4,627,799 | 12/1986 | Terauchi | 418/55.4 |
| 5,421,707 | 6/1995 | Daniels | 418/55.4 |
| 5,545,020 | 8/1996 | Fukanuma et al. | 418/55.4 |

FOREIGN PATENT DOCUMENTS

| | | | |
|---|---|---|---|
| 1227886 | 9/1989 | Japan | 418/55.2 |
| 1267380 | 10/1989 | Japan . | |
| 5240174 | 9/1993 | Japan . | |
| 6-2672 | 1/1994 | Japan | 418/55.2 |

*Primary Examiner*—John J. Vrablik
*Attorney, Agent, or Firm*—Burgess, Ryan & Wayne

[57] ABSTRACT

A scroll type compressor including mutually mating stationary and movable scrolls for producing compression. A circumferentially outer part of the movable scroll portion has a flat end surface and a chamferred surface. The chamferred surface tapers outwardly at an angle relative to the flat end surface greater than an allowable tilt angle of the movable scroll. A circumferentially inner part of the scroll portion includes a flat end surface only which has a groove to receive a tip seal, the tip seal having a height greater than a depth of the groove. The circumferentially outer part has an identical outer diameter to that of the base plate portion, and the base plate portion and the scroll portion are simultaneously machined.

11 Claims, 7 Drawing Sheets

SCROLL TYPE COMPRESSOR WITH CHAMFERED SCROLL WALL

BACKGROUND OF THE INVENTION

1. Field of the Invention

This present invention relates to a scroll type compressor used, for example, in an automotive air conditioning system.

2. Description of the Related Art

A known scroll type compressor has a housing, a stationary scroll, and a movable scroll. The stationary scroll comprises a base plate portion and a stationary scroll portion perpendicularly extending from the base plate portion, and the movable scroll also comprises a base plate portion and a movable scroll portion perpendicularly extending from the base plate portion for engagement with the stationary scroll portion to form a compression chamber between the stationary and movable scrolls. The movable scroll is arranged such that the movable scroll does not rotate about its own axis but can revolve around the axis of the compressor, so that the compression chamber is displaced from the peripheral region to the central region of the scrolls to reduce the volume of the compression chamber while the movable scroll revolves relative to the stationary scroll.

A conventional scroll type compressor is shown in FIG. 11 in the attached drawings. The compressor comprises a stationary scroll 80 and a movable scroll 90. The movable scroll 90 comprises a base plate portion 91 and a movable scroll portion 92 perpendicularly extending from the base plate portion 91. The end surface 92*a* of the movable scroll portion 92 is perpendicular to the movable scroll portion 92. The stationary scroll 80 also comprises a base plate portion 81 and a stationary scroll portion 82 perpendicularly extending from the base plate portion 81, with the end surface 82*a* being perpendicular to the stationary scroll portion 82.

The movable scroll 90 tends to tilt at a small angle θ relative to the axis 0 of the compressor while it revolves around the axis 0 of the compressor due to a reaction force of compressed fluid in the compression chamber or other parameters during the operation of the compressor. As a result, the outer edge of the movable scroll portion 92 between the end surface 92*a* and the outer side surface 92*b* contacts the base plate portion 81 of the stationary scroll 80. The revolving motion of the movable scroll 90 includes components of the movement in the direction toward the outer side surface 92*b* (in the upward direction U in the drawings) and in the direction toward the inner side surface 92*c* (in the downward direction D). When the movable scroll 90 moves in the downward direction D, the end surface 92*a* can make a sliding contact with the base plate portion 81 of the stationary scroll 80 and there is substantially no problem, but when the movable scroll 90 moves in the upward direction U, the outer edge of the movable scroll portion 92 makes an edge contact with the base plate portion 81 of the stationary scroll 80, so a problem arises that the base plate portion 81 of the stationary scroll 80 is scored. A similar problem occurs when the stationary scroll portion 82 makes an edge contact with the base plate portion 91 of the movable scroll 90.

Japanese Unexamined Patent Publication (Kokai) No. 5-240174 discloses a scroll type compressor and proposes to solve the above described problem. The first solution of this prior art is constructed such that the end surface of the movable scroll portion is tapered entirely from the inner surface of the movable scroll portion to the outer surface thereof relative to a plane perpendicular to the axis of the compressor. The second solution of this prior art is constructed such that the end surface of the movable scroll portion is entirely crowned.

In this prior art, the tapering angle of the end surface of the movable scroll portion is defined by tangent (tan θ) of a clearance between the end surface of the movable scroll portion and the bottom surface of the stationary scroll portion to an outer diameter of the movable scroll portion. However, this tapering angle of the end surface of the movable scroll portion does not necessarily coincide with an angle at which the movable scroll portion can actually tilt because of other parameters and tolerances. Therefore, if the tapering angle coincides with the tilting angle, the tapering end surface of the movable scroll portion makes a surface contact with the bottom surface of the stationary scroll portion and the desired effect can be realized, but if the tapering angle does not coincide with the tilting angle, the desired effect cannot be realized. For example, if the tapering angle is smaller than the tilting angle, the acute angled edge of the tapering end surface of the movable scroll portion on the outer side surface forcibly contacts the bottom surface of the stationary scroll portion to score the latter, and if the tapering angle is greater than the tilting angle, the obtuse angled edge of the tapering end surface of the movable scroll portion on the inner side surface also forcibly contacts the bottom surface of the stationary scroll portion to score the latter. This will be true if the tapering end surface is provided in the stationary scroll portion.

The second solution of this prior art necessitates machining to provide a crown on the end surface of the movable scroll portion, but the crown operation on the end surface is difficult and the manufacturing cost increases.

Japanese Unexamined Patent Publication (Kokai) No. 1-267380 discloses a scroll type compressor and shows a chamferred movable scroll portion. In this prior art, the end surface of the movable scroll portion is chamferred on both sides thereof, that is, the chamferring is effected on one edge of the movable scroll portion between the flat end surface and the outer side surface and on another edge of the movable scroll portion between the flat end surface and the inner side surface, along the circumferentially full length thereof. This arrangement may also serve to solve the above described problem.

However, the movable scroll portion usually tilts to one side only so that only a part of the end surface of the movable scroll portion contact the stationary base plate portion. In addition, the end surface of the movable scroll portion must to cooperate with the stationary base plate portion to effect a sealing function for the compression chamber. Therefore, if the end surface of the movable scroll portion is chamferred on both sides thereof, the sealing function will be deteriorated and the performance of the compressor may decrease. In addition, in any of the above described prior art, the tapering or the chamferring is provided along the circumferentially full length of the movable scroll portion, and as a result, the manufacturing cost increases and the performance of the compressor may decrease.

SUMMARY OF THE INVENTION

The object of the present invention is to solve the above described problems and to provide a scroll type compressor which is constructed to mitigate any scoring of the stationary or movable base plate portion and which can be manufactured with a least increase in the manufacturing cost and with a least loss of the performance of the engine.

According to the present invention, there is provided a scroll type compressor comprising a housing having a first axis; a stationary scroll including a base plate portion and a scroll portion perpendicularly extending from the base plate portion; a movable scroll including a base plate portion and a scroll portion perpendicularly extending from the base plate portion for engagement with the scroll portion of the stationary scroll for forming a compression chamber between the stationary and movable scrolls; the movable scroll having a second axis parallel to the first axis and being arranged such that the movable scroll does not rotate about the second axis but can revolve around the first axis; and a circumferentially outer part of at least one of the scroll portions of the stationary and movable scrolls comprising an inner side surface, an outer side surface, a flat end surface perpendicular to the first axis, and a chamferred surface between the outer side surface and the flat end surface, the chamferred surface tapering outwardly at an angle relative to the flat end surface greater than an allowable tilt angle of the movable scroll relative to the first axis.

In this arrangement, the allowable maximum tilt angle of the movable scroll can be calculated, based on an outer diameter of the movable scroll portion, a clearance between the end surface of the movable scroll portion and the bottom surface of the stationary base plate portion, and other parameters such as tolerances of other portions. Chamferring can be achieved during the step of shaping the movable scroll portion. That is, the movable scroll portion is initially made as a blank of a cast or forged product and it is machined by a cutting tool to shape the outer circumferential surface of the movable scroll portion, and the chamferring can be achieved during this machining step.

The scroll portion, for example, of the movable scroll includes the chamferred surface as well as the flat end surface, and the tapering angle of the chamferred surface is determined to be the minimum within the range greater than the allowable maximum tilt angle of the movable scroll. In addition, the angle between the chamferred surface and the flat end surface is an obtuse angle as close as possible to 180 degrees. Therefore, when the movable scroll revolves with the movable scroll in the tilted position, the movable scroll makes a sliding contact with the base plate portion of the stationary scroll even if the movable scroll moves in the direction to the outer side surface of the movable scroll or even if the movable scroll moves in the direction to the inner side surface of the movable scroll, since the angle between the chamferred surface and the flat end surface is an obtuse angle, as close as possible to 180 degrees. The scroll portion of the stationary scroll can include the chamferred surface, and in this case, the chamferred surface of the scroll portion of the stationary scroll can make a sliding contact with the base plate portion of the movable scroll.

Since the movable scroll tilts so that the outer end portion of the end surface of the movable scroll approaches the bottom surface of the stationary scroll when the movable scroll revolves, it is necessary and sufficient to provide the chamferred surface only on the side of the outer side surface. Since the compressor according to the present invention includes the chamferred surface only at the necessary and sufficient side, the machining operation of the scroll portion having the chamferred surface is easier, compared with the case in which the chamferred surface is provided on both side of the movable scroll portion, and/or the chamferred surface is provided along the full length of the movable scroll portion. In addition, as the chamferring is not effected on the side of the inner side surface, a sealing function for the compression chamber is appropriately ensured.

Preferably, the scroll portion of the movable scroll comprises the chamferred surface. Also, preferably, the scroll portion of the movable scroll comprises the chamferred surface, and the scroll portion of the stationary scroll comprises no such chamferred surface.

Preferably, the stationary scroll comprises a circular outer circumferential wall constituting a part of the housing.

Preferably, the scroll portion includes a circumferentially inner part contiguous to the circumferentially outer part, the circumferentially inner part comprising an inner side surface, an outer side surface, and a flat end surface flush with the flat end surface of the circumferentially outer part, the flat end surface of the circumferentially inner part having a groove and a tip seal arranged in the groove, the tip seal having a height greater than a depth of the groove, the chamferred surface being arranged only in the area of the scroll portion where no groove is arranged. Preferably, the circumferentially outer part of the scroll portion is formed along approximately one half of a circle.

In this case, a compression chamber is not provided on the outer side of the circumferentially outer part of the scroll portion extending along approximately one half of a circle. A compression chamber is provided on the inner side of the circumferentially outer part of the scroll portion extending along approximately one half of a circle, but the pressure of compressed fluid is still low at this stage of the compression. Accordingly, a tip seal can be deleted in the circumferentially outer part of the scroll portion, in order to reduce the manufacturing cost.

The above described Japanese Unexamined Patent Publication (Kokai) No. 5-240174 also discloses a tip seal arranged in the scroll portion. However, according to the description of this prior art, this tip seal is of a floating type. That is, the tip seal has a height smaller than a depth of its groove, and it moves beyond the end surface of the scroll portion to the surface by the back pressure. In the present invention, the tip seal always projects from the flat end surface of the scroll portion, and the scroll portion does not directly contact the stationary or movable base plate portion even when the movable scroll portion tilts as it revolves. In this way, the chamferred surface is arranged only in the area of the scroll portion where no groove is arranged to achieve the above described effect, and the tip seal arranged in the remaining part only of the scroll portion can ensure a sealing function while enabling a decrease in the manufacturing cost and preventing any scoring.

Preferably, the base plate portion of the movable scroll comprises a circular outer shape, and the circumferentially outer part of the scroll portion having the chamferred surface comprising a partially circular outer shape substantially corresponding to the circular outer shape of the base plate portion, obtained by simultaneously machining the base plate portion and the scroll portion of the movable scroll.

This design allows the compressor to be constructed in a compact size, by thinning the outer wall of the base plate portion and the scroll portion. However, since the base plate portion is cylindrical and there is no radial projection on the base plate portion of the movable scroll, the axial movement of the latter is hardly controlled so that the movable scroll tends to tilt more and more. The above described effects of the present invention are advantageous in the scroll type compressor having a movable scroll which tilts in this manner.

Preferably, the chamferred surface is connected to the flat end surface via a rounded surface portion. In this feature, it is possible to prevent the movable scroll portion from scoring the stationary plate portion.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
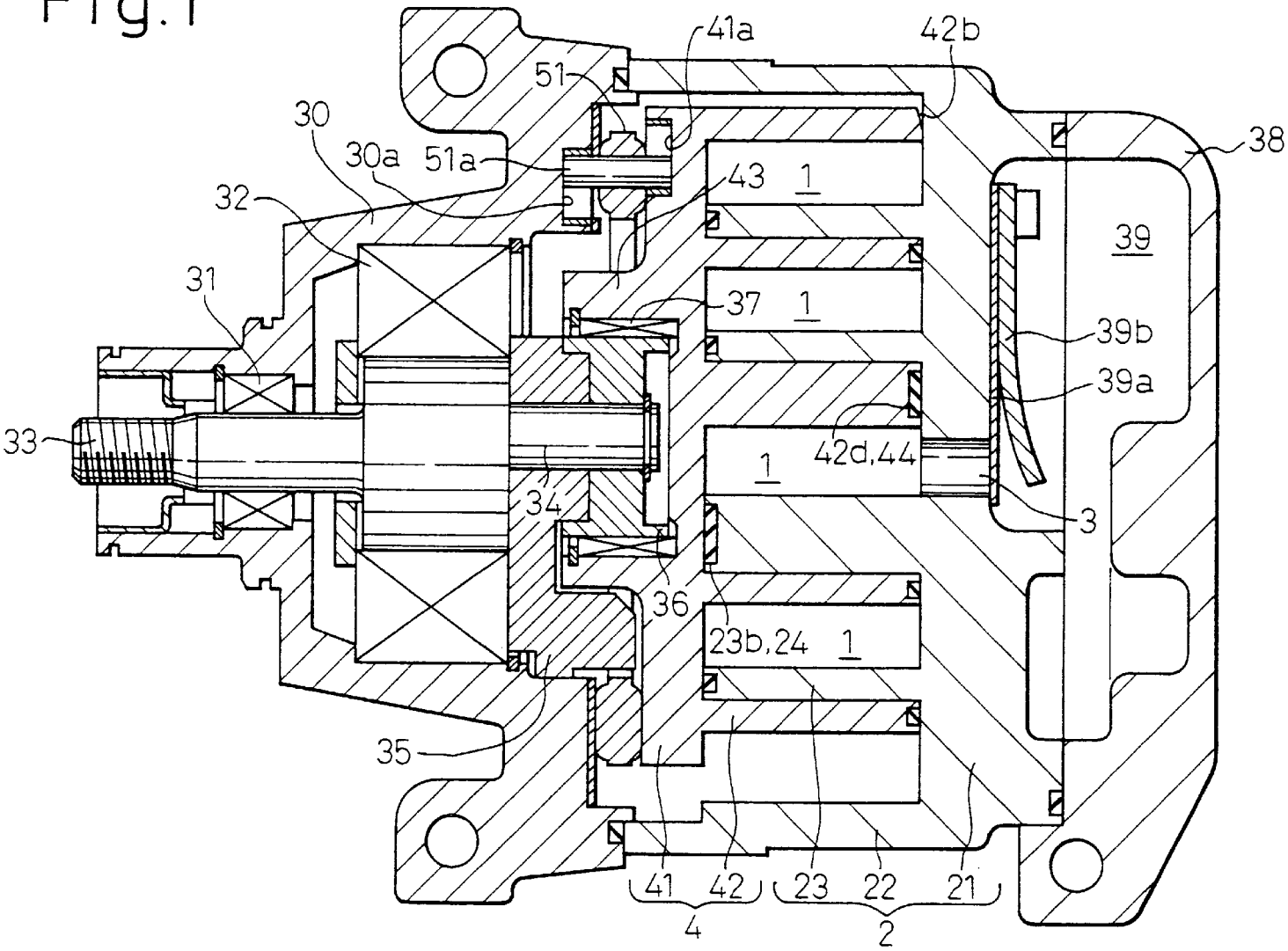
FIG. 1 is a cross-sectional view of the scroll type compressor according to the first embodiment of the present invention.

FIGS. 1 to 7 show the scroll type compressor according to the first embodiment of the present invention. As shown in FIG. 1, the compressor comprises a stationary scroll 2 and a movable scroll 4 for engagement with the stationary scroll 2 for forming a compression chamber 1 between the stationary and movable scrolls 2 and 4. The stationary scroll 2 comprises a disk-like base plate portion 21, a shell portion 22 integrally formed with the base plate portion 21 and constituting a central part of a housing of the compressor, and a scroll portion 23 perpendicularly and forwardly extending from the base plate portion 21. The scroll portion 23 is formed based on an involute curve or the like. The movable scroll 4 comprises a disk-like base plate portion 41, a scroll portion 42 perpendicularly and rearwardly extending from the base plate portion 41 and formed based on an involute curve or the like, and a boss portion 43 formed on the front side of the base plate portion 41.

Figure 2:
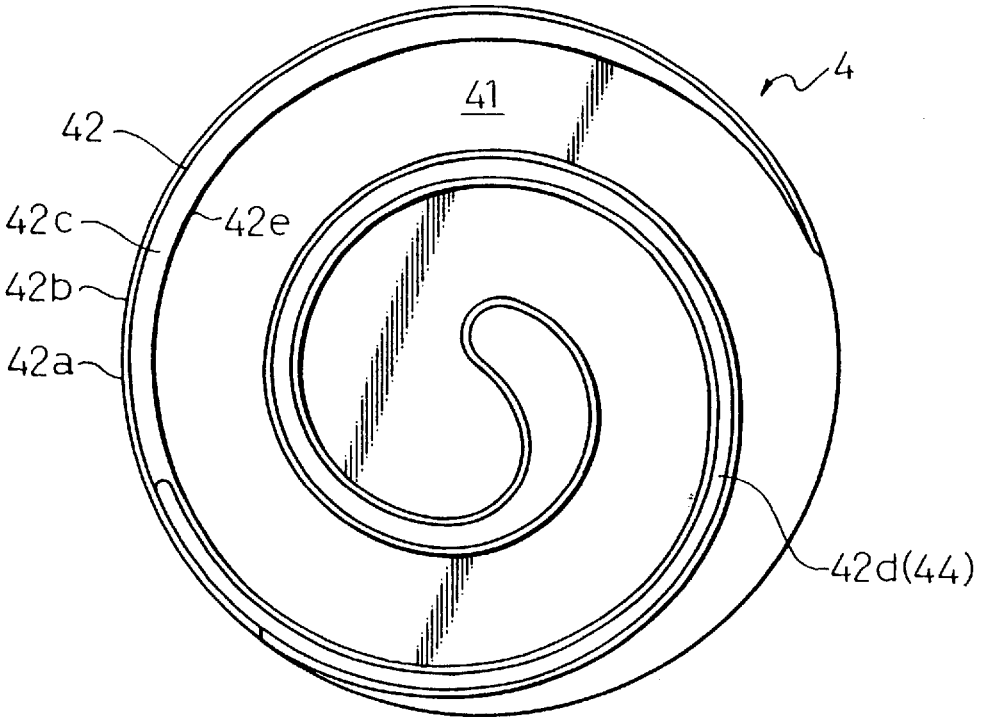
FIG. 2 is a plan view of the movable scroll of FIG. 1.
Figure 3:
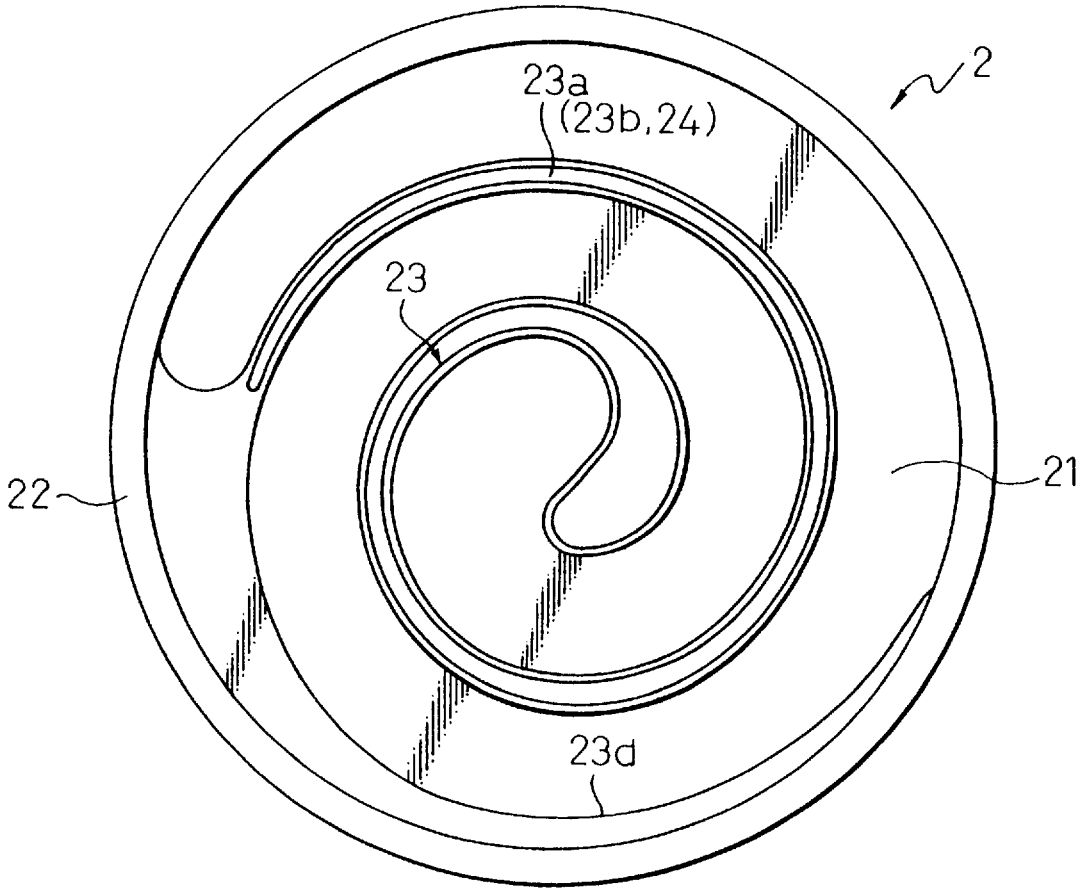
FIG. 3 is a plan view of the stationary scroll of FIG. 1.
Figure 4:
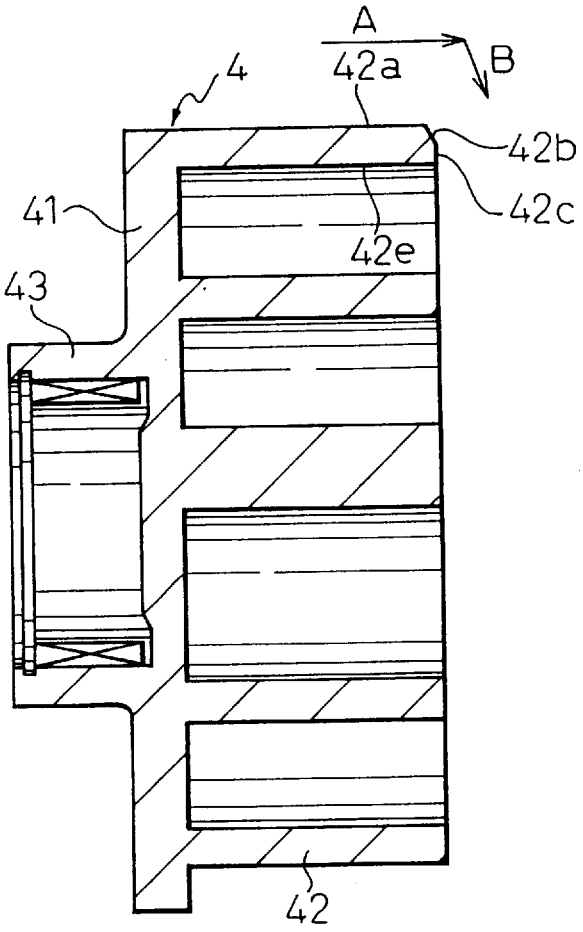
FIG. 4 is a cross-sectional view of the movable scroll in the machining process.

The movable scroll 4 is fabricated in the following way. An aluminum alloy blank is cast, and the blank is then machined to shape the boss portion 43 and the scrolling wall of the scroll portion 42 perpendicularly projecting from the base plate portion 41, as shown in FIG. 2 and 4. The scroll portion 42 thus has an outer side surface 42*a*, a flat end surface 42*c*, and an inner side surface 42*e*.

The cutting tool of the machine tool is then moved in the direction of the arrow A in FIG. 4, to simultaneously machine or cut the outer circumferential surface of the base plate portion 41 and the outer side surface 42*a* of the circumferentially outer part of the scroll portion 42, which extends from the outer scroll end by approximately one half of a circle. Therefore, the circumferentially outer part of the scroll portion 42 is gradually thinned, as shown in FIG. 2, and the outer side surface 42*a* of the circumferentially outer part coincides with the circular outer surface of the base plate portion 41.

The cutting tool of the machine tool is then moved in the direction of the arrow B in FIG. 4, to cut the outer edge of the circumferentially outer part of the scroll portion 42 to form a chamferred surface 42*b* between the flat end surface 42*c* and the outer side surface 42*a*. The chamferred surface 42*b* extends only along the circumferentially outer part of the scroll portion 42 that was previously thinned. A groove 42*d* is cut in the flat end surface 42*c* of the circumferentially outer part of the scroll portion 42 which is contiguous to the circumferentially outer part but the wall of which is not so thinned. A tip seal 44 made of PTFE is arranged in the groove 42d, the tip seal 44 having a height greater than a depth of the groove 42*d*.

Figure 5:
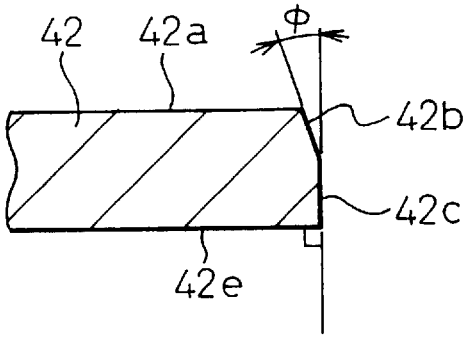
FIG. 5 is an enlarged cross-sectional view of the circumferentially outer part of the movable scroll.

The angle $\phi$ of the taper, shown in FIG. 5, of the chamferred surface 42*b* relative to the flat end surface 42*c* is determined in the following way. First, an allowable tilt angle $\theta$, shown in FIGS. 6 and 7, of the movable scroll 4 relative to the axis of the compressor or of the stationary scroll 2, is calculated, based on an outer diameter of the movable scroll portion 42, a clearance between the end surface 42*c* of the movable scroll portion 42 and the bottom surface of the stationary base plate portion 21, and other parameters such as tolerances of other portions. The angle $\phi$ of the taper is then determined to be one which is higher than the allowable tilt angle $\phi$ and is as small as possible in this range. In the illustrated embodiment, the allowable tilt angle $\phi$ was 2 to 3 degrees, and the angle $\phi$ of the taper is selected in the range from 5 to 30 degrees. Therefore, the chamferred surface 42*b* and the end surface 42*c* together form an obtuse angle close to 180 degrees.

The stationary scroll 2 is also fabricated from an aluminum alloy cast blank. In the stationary scroll 2, the stationary scroll portion 23 perpendicularly extends from the stationary base plate portion 21, and the stationary base plate portion 21 has a flat end surface 23*a* between inner and outer side surfaces. The flat end surface 23*a* is perpendicular to the stationary base plate portion 21. The flat end surface 23*a* of the stationary scroll portion 23 has a groove 23*b* along the scroll thereof and a tip seal 24 is arranged in the groove 23*b*, the tip seal 24 having a height greater than a depth of the groove 23*b*. The circumferentially outer part of the stationary scroll 2 forms a part of the compression chamber 1 at which the pressure is low, and a groove and a tip seal are not provided to reduce the production cost.

The other elements of the compressor are described briefly. As shown in FIG. 1, the compressor comprises a front housing 30 fastened to the shell 22 of the stationary scroll 2 by fastening means. A drive shaft 33 is rotatably supported by the front housing 30 via a shaft seal device 31 and a main bearing 32, and a slide key 34 extends from the larger end portion of the drive shaft 33. A counter weight 35 and a driving bush 36 are fitted on the slide key 34, and the boss portion 43 of the movable scroll 4 is supported by the driving bush 36 via a bearing 37.

A movable ring 51 is arranged between the front housing and the movable base plate portion 41, the movable ring 51 having a plurality of axially extending self-rotation preventing pins 51*a*. The self-rotation preventing pins 51*a* are engaged in regulating recesses 30*a* in the front housing 30 and in regulating recesses 41*a* in the movable base plate portion 41 via liners, respectively, whereby a radial force applied from the drive shaft 33 and the movable base plate portion 41 is born and the self-rotation of the movable scroll 2 around its own axis is prevented. A portion of the movable ring 51 where the self-rotation preventing pins 51*a* are not provided abuts against the front housing 30 and the movable base plate portion 41 to bear a thrust force applied from the movable base plate portion 41.

The front housing 30 has a not shown inlet which is connected to a refrigerating circuit, the inlet being in communication with the compression chamber 1 in the suction stage via openings in the movable ring 51. The compressor also comprises a rear housing 38 fastened with the shell 22 of the stationary scroll 2 by fastening means, the rear housing 38 having a discharge chamber 39. The discharge chamber 39 is in communication with the compression chamber 1 via a discharge port 3 provided in the center of the stationary base plate portion 21, a discharge valve 39*a* and a retainer 39*b*, and in communication with the refrigerating circuit via a not shown exit.

In this scroll type compressor, the drive shaft 33 is driven in rotation by an engine of an automobile via an electric clutch. Therefore, the slide key 34 is driven, so the driving bush 36 causes the movable scroll 4 to revolve on a certain orbital radius according to the cooperation of the movable ring 51, the self-rotation preventing pins 51*a* and the regulating recesses 30*a* and 41*a*. In this movement, the volume of the compression chamber 1 constituted by the stationary base plate portion 21, the stationary scroll portion 23, the movable base plate portion 41, and the movable scroll portion 42 is reduced and displaced to the central area of the scroll. Therefore, the refrigerating gas is introduced from the inlet into the compression chamber 1 in the suction stage, and the refrigerating gas compressed due to the displacement of the compression chamber 1 is discharged into the discharge chamber 39 via the discharge port 3 and the discharge valve 39*a*.

Figure 6:
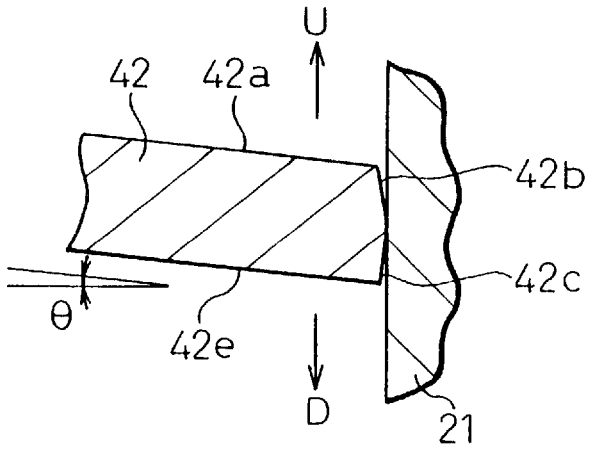
FIG. 6 is an enlarged cross-sectional view of the circumferentially outer part of the movable scroll and the stationary base plate portion with the movable scroll in the tilted position.
Figure 7:
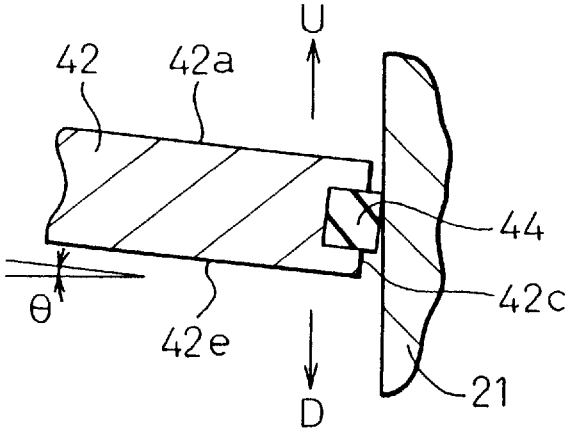
FIG. 7 is an enlarged cross-sectional view of the circumferentially inner part of the movable scroll and the stationary base plate portion with the movable scroll in the tilted position.

During the operation of this scroll type compressor, the movable scroll 90 tends to tilt at a small angle $\phi$ relative to the axis 0 of the compressor while it revolves due to a reaction force of compressed fluid in the compression chamber or other parameters, as shown in FIGS. 6 and 7. In particular, this tendency is not avoidable in this compressor since the movable base plate portion 41 is formed in a circular disk-like shape and the circumferentially outer half port of the movable scroll portion 42 is formed in coincidence with the outer shape of the movable base plate portion 41 in order to reduce the size in a diametrical direction.

According to the present invention, in this situation, the movable scroll portion 42 contacts the stationary base plate portion 21 at an obtuse angle close to 180 degrees and can make a sliding contact therewith, so that the movable scroll portion 42 does not remarkably score the base plate portion 41 of the stationary scroll 4, even when the movable scroll portion 42 moves in the direction toward the outer side surface 42*a* (in the upward direction U in the drawings) and in the direction toward the inner side surface 42*e* (in the downward direction D). In addition, in the circumferentially inner part of the movable scroll portion 42, the projecting tip seal 44 makes a sliding contact with the stationary base plate portion 21, so that the movable scroll portion 42 does not remarkably score the base plate portion 41 of the stationary scroll 4.

Also, the flat end surface 23*a* of the stationary scroll portion 23 is perpendicular to the latter, but the projecting tip seal 24 is arranged in the groove 23*b* of the flat end surface 23*a*. Therefore, the movable scroll portion 42 does not remarkably score the base plate portion 41 of the stationary scroll 4, even when the movable scroll portion 42 revolves in the tilted condition.

Also, in this scroll type compressor, the chamferred surface 42*b* is arranged only in the circumferentially outer part of the movable scroll portion 42 where the outer side surface 42*a* is machined, i.e., in the area of the scroll portion where any groove and any tip seal are not arranged. Therefore, in this scroll type compressor, the tip seals 44, and 24 can provide a stable sealing function, and a production cost can be reduced due to omission of the tip seals at a particular portion of the scroll portion.

As described in greater detail, the scroll type compressor according to the present invention is constructed so as to mitigate any scoring of the stationary or movable base plate portion, and can be manufactured with the least increase in the manufacturing cost and with the least loss of the performance of the engine. That is, this scroll type compressor is not expensive, yet can have a high compression efficiency and a good durability.

Figure 8:
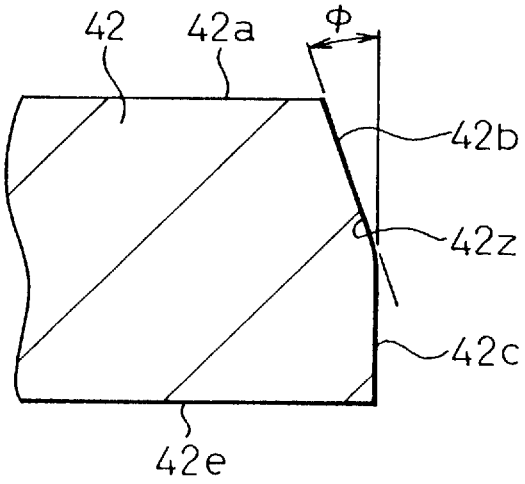
FIG. 8 is a cross-sectional view of the circumferentially outer part of the movable scroll of the scroll type compressor according to the second embodiment of the present invention.
Figure 10:
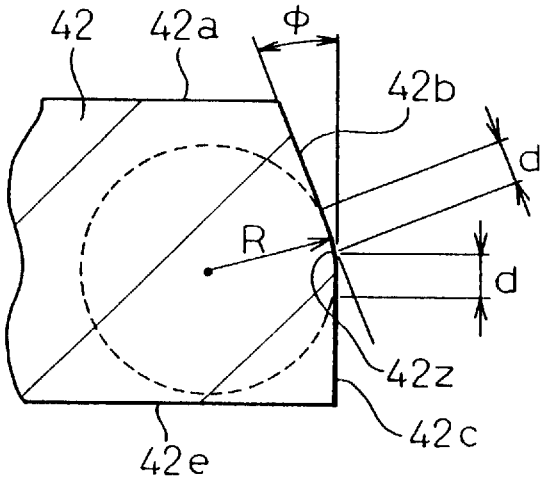
FIG. 10 is a cross-sectional view of the circumferentially outer part of the movable scroll of FIG. 8.
Figure 11:
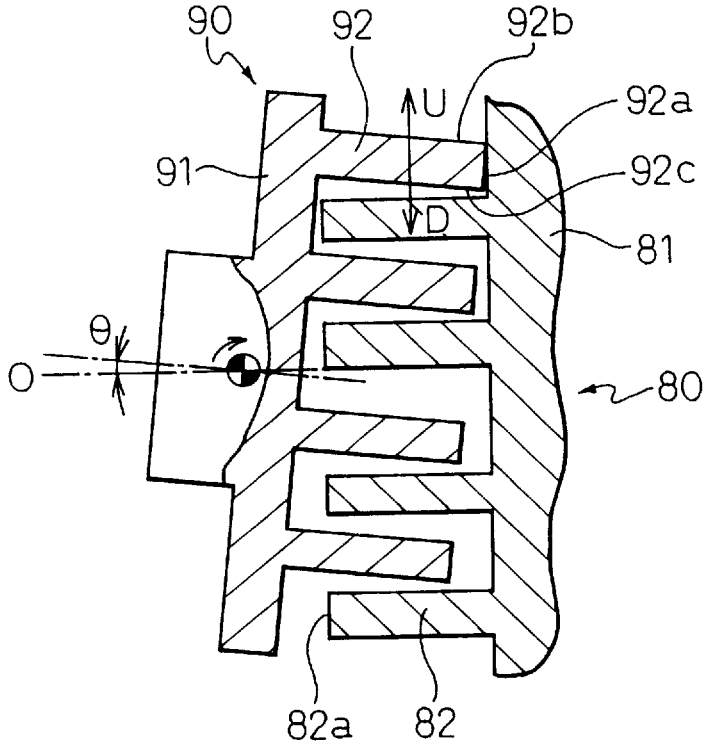
Fig. 11 (PRIOR ART)
FIG. 11 is a cross-sectional view of a stationary scroll and a movable scroll of a conventional scroll type compressor.

FIGS. 8 and 10 show the scroll type compressor according to the second embodiment of the present invention. This compressor comprises elements similar to those of the first embodiment, except that the chamferred surface 42*b* of the movable scroll portion 42 is connected to the flat end surface 42*c* via a rounded surface portion 42*z*, as shown in FIG. 8. The rounded surface portion 42*z* is formed by a brush or a sand paper after the chamferred surface 42*b* and the flat end surface 42*c* are formed.

In this scroll type compressor, since the chamferred surface 42*b* is connected to the flat end surface 42*c* via the rounded surface portion 42*z*, the movable scroll portion 42 can make a sliding contact with the stationary base plate portion 21 at the rounded surface portion 42*z*, the contact surface pressure is reduced so that the movable scroll portion 42 does not remarkably score the base plate portion 41 of the stationary scroll 4.

Figure 9:
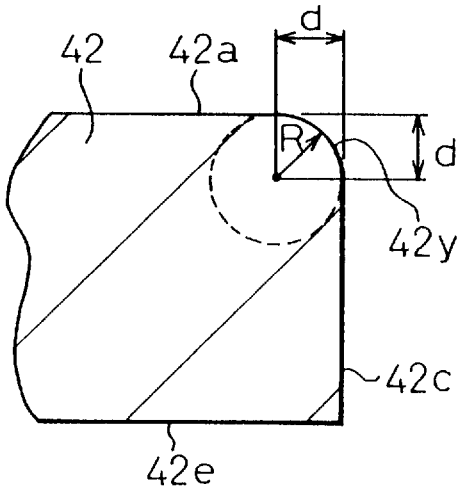
FIG. 9 is a cross-sectional view of the circumferentially outer part of the movable scroll when a general rounded chamferring is applied.

FIG. 9 shows that a general rounded chamferring 42*y* is applied to the flat end surface 42*c* of the movable scroll portion 42 on the side of the outer side surface 42*a*. In this structure, a transition d is substantially identical to the radius R of the rounded chamferring 42*y*. However, in the compressor of FIG. 10, it is possible to ensure that the radius R of the rounded chamferring 42*y* is much greater than the transition d. Therefore the contact surface pressure is reduced so that the movable scroll portion 42 does not remarkably score the base plate portion 41 of the stationary scroll 4.

We claim:

1. A scroll type compressor comprising:

a housing having a first axis;

a stationary scroll including a base plate portion and a scroll portion perpendicularly extending from the base plate portion;

a movable scroll including a base plate portion and a scroll portion perpendicularly extending from the base plate portion for engagement with the scroll portion of the stationary scroll for forming a compression chamber between the stationary and movable scrolls;

the movable scroll having a second axis parallel to the first axis and being arranged such that the movable scroll does not rotate about the second axis but can revolve around the first axis; and a circumferentially outer part of at least one of the scroll portions of the stationary and movable scrolls comprising an inner side surface, an outer side surface, a flat end surface perpendicular to the first axis, and a chamferred surface between the outer side surface and the flat end surface, the chamferred surface tapering outwardly at an angle not exceeding 30 degrees relative to the flat end surface.

2. A scroll type compressor according to claim 1, wherein the scroll portion of the movable scroll comprises a chamferred surface.

3. A scroll type compressor according to claim 1, wherein the scroll portion of the movable scroll comprises a chamferred surface, and the scroll portion of the stationary scroll does not comprise a chamferred surface.

4. A scroll type compressor according to claim 3, wherein the stationary scroll comprises a circular outer circumferential wall constituting a part of the housing.

5. A scroll type compressor according to claim 1, wherein the scroll portion includes a circumferentially inner part contiguous to the circumferentially outer part, the circumferentially inner part comprising an inner side surface, an outer side surface, and a flat end surface flush with the flat end surface of the circumferentially outer part, the flat end surface of the circumferentially inner part having a groove and a tip seal arranged in the groove, the chamferred surface being arranged only in the area of the scroll portion where a groove is not arranged.

6. A scroll type compressor according to claim 5, wherein the circumferentially outer part of the scroll portion is formed along approximately one half of a circle.

7. A scroll type compressor according to claim 5, wherein the base plate portion of the movable scroll comprises a circular outer shape, and the circumferentially outer part of the scroll portion having the chamferred surface comprising a partially circular outer shape substantially corresponding to the circular outer shape of the base plate portion, obtained by simultaneously machining the base plate portion and the scroll portion.

8. A scroll type compressor according to claim 1, wherein the chamferred surface is connected to the flat end surface via a rounded surface portion.

9. A scroll type compressor according to claim 1 wherein the chamfered surface tapers outwardly at an angle greater than 5 degrees and less than 30 degrees relative to the flat end surface.

10. A scroll type compressor according to claim 1 wherein only the circumferentially outer part is chamfered.

11. A scroll type compressor comprising:

a housing having a first axis;

a stationary scroll including a base plate portion and a scroll portion perpendicularly extending from the base plate portion;

a movable scroll including a base plate portion and a scroll portion perpendicularly extending from the base plate portion for engagement with said scroll portion of the stationary scroll for forming a compression chamber between the stationary and movable scrolls;

said movable scroll having a second axis parallel to the first axis and being arranged such that the movable scroll does not rotate about the second axis but can revolve around the first axis; and a circumferentially outer part of at least one of the scroll portions of the stationary and movable scrolls comprising an inner side surface, an outer side surface, a flat end surface perpendicular to the first axis, and a chamfered surface between the outer side surface and the flat end surface, the chamfered surface tapering outwardly at an angle relative to the flat end surface greater than an allowable tilt angle of the movable scroll relative to the first axis, and wherein the chamfered surface is connected to the flat end surface via a rounded surface portion.

* * * * *